US011123622B1

(12) United States Patent
Ward

(10) Patent No.: US 11,123,622 B1
(45) Date of Patent: Sep. 21, 2021

(54) EXTENDED SKATING RINK AND METHOD OF PLAY THEREON

(71) Applicant: Lycurgus Barnhill Ward, Marco Island, FL (US)

(72) Inventor: Lycurgus Barnhill Ward, Marco Island, FL (US)

( * ) Notice: Subject to any disclaimer, the term of this patent is extended or adjusted under 35 U.S.C. 154(b) by 0 days.

(21) Appl. No.: 17/220,804

(22) Filed: Apr. 1, 2021

(51) Int. Cl.

| | |
|---|---|
| ***A63C 19/10*** | (2006.01) |
| ***A63B 67/00*** | (2006.01) |
| ***A63B 63/00*** | (2006.01) |
| ***A63B 69/40*** | (2006.01) |
| ***A63B 71/06*** | (2006.01) |
| *A63B 59/20* | (2015.01) |
| *A63B 43/00* | (2006.01) |

(52) U.S. Cl.
CPC ..... *A63B 67/002* (2013.01); *A63B 63/00* (2013.01); *A63B 69/40* (2013.01); *A63B 71/0672* (2013.01); *A63C 19/10* (2013.01); *A63B 43/008* (2013.01); *A63B 59/20* (2015.10); *A63B 2071/0694* (2013.01)

(58) Field of Classification Search
CPC ..... A63B 67/002; A63C 19/10; E01C 13/003; A63H 18/02; A63F 5/00; A63F 5/0005; A63F 9/02
See application file for complete search history.

(56) References Cited

U.S. PATENT DOCUMENTS

| | | | | |
|---|---|---|---|---|
| 1,823,049 A | | 6/1906 | Kelly | |
| 1,836,561 A | | 11/1906 | Bush | |
| 867,330 A | | 10/1907 | Young | |
| 905,941 A | | 12/1908 | Simpson | |
| 1,961,595 A | | 6/1910 | Fitch | |
| 1,091,484 A | * | 3/1914 | Cohn | A63C 19/10 472/89 |
| 1,462,208 A | * | 7/1923 | Mayo | E04B 2/825 52/211 |

(Continued)

FOREIGN PATENT DOCUMENTS

| | | |
|---|---|---|
| BE | 1010123 A3 | 1/1998 |
| BE | 1011751 A6 | 12/1999 |

(Continued)

OTHER PUBLICATIONS

"Rules of the Game: Rollerball", https://speedrally.wordpress.com/2017/01/12/rules-of-the-game-rollerball/, posted Jan. 12, 2017 (Year: 2017).*

(Continued)

*Primary Examiner* — Laura Davison
(74) *Attorney, Agent, or Firm* — QuickPatents; Kevin Prince

(57) ABSTRACT

A roller skating rink for players to play a skating game utilizes one or more game implements. A skating track is made from a plurality of track sections. The roller skating rink includes concave channel sections on one side of the track sections and has a lower end and an upper end that are substantially vertically aligned. One or more propelling devices are each adapted to propel one of the game implements into the roller skating rink. One or more scoring receptacles are situated for receiving one or more of the game implements therein proximate the upper end of the concave peripheral wall. A method of game play is further disclosed.

14 Claims, 8 Drawing Sheets

(56) References Cited

U.S. PATENT DOCUMENTS

| | | | | |
|---|---|---|---|---|
| 1,648,196 | A | 11/1927 | Rohmer | |
| 2,466,613 | A | 4/1949 | Richardson | |
| 3,266,800 | A * | 8/1966 | Yee | A63C 19/10 472/89 |
| 3,277,878 | A | 10/1966 | Pankratz | |
| 3,343,793 | A * | 9/1967 | Waser | A63F 7/3622 238/1 OR |
| 3,467,073 | A | 9/1969 | Rhodes | |
| 3,480,257 | A | 11/1969 | Bourn | |
| 3,508,405 | A | 4/1970 | Koch | |
| 3,615,110 | A | 10/1971 | Fugate | |
| 3,633,862 | A | 1/1972 | Breen | |
| 3,810,706 | A * | 5/1974 | Grimm | E01F 15/025 404/1 |
| 3,838,676 | A | 10/1974 | Kahelin | |
| 3,923,301 | A | 12/1975 | Myers | |
| 3,923,304 | A | 12/1975 | Warren | |
| 3,941,381 | A | 3/1976 | Trbovich | |
| 3,946,529 | A | 3/1976 | Chevaux | |
| D244,306 | S | 5/1977 | Bisch | |
| 4,045,026 | A | 8/1977 | Gillespie | |
| 4,098,508 | A | 7/1978 | Gandy | |
| 4,172,593 | A | 10/1979 | Palakanis | |
| 4,194,733 | A | 3/1980 | Whitehouse, Jr. | |
| 4,198,043 | A | 4/1980 | Timbes | |
| D256,827 | S | 9/1980 | Allen, 3rd | |
| 4,258,911 | A | 3/1981 | Alexander | |
| 4,273,339 | A | 6/1981 | Fortunato | |
| 4,278,247 | A | 7/1981 | Joppe | |
| 4,286,806 | A | 9/1981 | Bergstein | |
| 4,379,551 | A | 4/1983 | Ahrens | |
| 4,492,380 | A | 1/1985 | Saytar | |
| 4,502,690 | A | 3/1985 | Ruperto | |
| 4,595,205 | A | 6/1986 | Ruperto | |
| 4,765,622 | A | 8/1988 | Rienzo | |
| 4,778,430 | A | 10/1988 | Goldfarb | |
| 4,805,897 | A | 2/1989 | Dubeta | |
| 4,909,517 | A | 3/1990 | Furlong | |
| 5,033,734 | A | 7/1991 | Jalbert | |
| 5,137,497 | A | 8/1992 | Dubeta | |
| 5,213,333 | A | 5/1993 | Petrovich | |
| 5,312,109 | A | 5/1994 | Cagle | |
| 5,320,350 | A | 6/1994 | Savage | |
| 5,382,028 | A | 1/1995 | Sciandra | |
| 5,427,574 | A | 6/1995 | Donnelly-Weide | |
| 5,507,271 | A | 4/1996 | Actor | |
| 5,524,310 | A | 6/1996 | Farnen | |
| 5,540,622 | A | 7/1996 | Gold | |
| 5,599,025 | A | 2/1997 | Pobee-Mensah | |
| 5,624,122 | A | 4/1997 | Winkelhorn | |
| 5,660,595 | A * | 8/1997 | Ferro, Jr. | A63C 19/04 472/89 |
| 5,718,412 | A | 2/1998 | Levanas | |
| 5,897,438 | A | 4/1999 | Kunz | |
| 5,906,545 | A | 5/1999 | Eden | |
| 5,993,335 | A | 11/1999 | Eden | |
| 6,062,983 | A | 5/2000 | Butsook | |
| 6,149,529 | A | 11/2000 | Fowler et al. | |
| 6,186,902 | B1 | 2/2001 | Briggs | |
| 6,450,891 | B1 | 9/2002 | Dubeta | |
| 6,527,646 | B1 | 3/2003 | Briggs | |
| 7,007,978 | B1 | 3/2006 | Purdom | |
| 7,958,876 | B2 | 6/2011 | Lay | |
| 8,435,142 | B2 | 5/2013 | Gibson | |
| 9,656,136 | B2 | 5/2017 | Van Alen | |
| 9,844,203 | B1 | 12/2017 | Mori | |
| D838,800 | S | 1/2019 | Ozsoz | |
| 10,493,343 | B2 | 12/2019 | Horner et al. | |
| 10,569,160 | B1 | 2/2020 | Peel | |
| 2004/0029654 | A1 | 2/2004 | Bates | |
| 2007/0021241 | A1 | 1/2007 | Geller | |
| 2009/0286609 | A1 | 11/2009 | Dyrdek | |

FOREIGN PATENT DOCUMENTS

| | | | |
|---|---|---|---|
| CN | 107401322 | A | 11/2017 |
| CN | 207583079 | U | 7/2018 |
| EP | 2196244 | A2 | 6/2010 |
| EP | 2628509 | A1 | 8/2013 |
| FI | 96486 | B | 3/1996 |
| FI | 99262 | C | 2/1998 |
| FR | 2669834 | A1 | 6/1992 |
| RU | 133429 | U1 | 10/2013 |
| WO | 20023400341 | A1 | 10/2001 |
| WO | 2011004381 | A1 | 1/2011 |

OTHER PUBLICATIONS

"Rollerball Official Trailer #1—James Caan Movie (1975) HD", https://www.youtube.com/watch?v=aVUxK1mNups, uploaded by Movieclips Classic Trailers on Oct. 5, 2012 (Year: 2012).*

"The Evolution of Rollerball", https://speedrally.wordpress.com/2017/01/12/the-evolution-of-rollerball/, posted Jan. 12, 2017 (Year: 2017).*

Rollersport, Inc. Vintage Track Plans, (c) 1989, www.skatelogforum.com/pdf/track-plans.pdf (year: 1989).

* cited by examiner

EXTENDED SKATING RINK AND METHOD OF PLAY THEREON

CROSS-REFERENCE TO RELATED APPLICATIONS

Not applicable.

STATEMENT REGARDING FEDERALLY SPONSORED RESEARCH AND DEVELOPMENT

Not Applicable.

FIELD OF THE INVENTION

This invention relates to skating, and more particularly to an extended skating rink and a method of playing a game thereon.

BACKGROUND

Team sport on roller skates was developed as early as the 1930's and 1940's, and continues in alternative forms today as a speed and body blocking sport without playing devices, device control apparatuses, device expelling apparatuses, or a concave enclosure along the perimeter of the skating area that may be utilized as an indirect path to scoring receptacles. The lack of devices, and the tools that support the use and implementation of device play is a major shortcoming for the field and accordingly, there is a need for a sport that involves a playing surface which extends beyond the surface available to participants in the sport, and which allows for the simultaneous attempts at control of one or more playing devices (balls) which have been introduced into play by one or more device expelling apparatuses, for placement in a unique manner into one or more scoring receptacles, in a predetermined manner where the playing surface must be utilized in order to direct the playing device into one of the receptacles, and where control of the playing device is done utilizing a device handling tool, shortcomings which the present invention solves.

SUMMARY OF THE INVENTION

The present invention is a roller skating rink for players to play a skating game that utilizes one or more game implements. A plurality of track sections each include a first end, a second end, a first side, and a second side. Each track section rests on a ground surface and is fixed end-to-end with another of the track sections to form a closed-loop skating track for supporting the players and the game implements thereon. Each track section comprises a plurality of abutting track panels. Each end, of each track section has a longitudinal axis substantially orthogonal to the end, respectively, the longitudinal axes being mutually non-aligned.

A plurality of channel sections are each fixed along at least one side of each track section, each channel section having a lower end and an upper end. The lower end and the upper end are substantially vertically aligned. The concave channel sections of two abutting track panels each mutually abut each other.

The first end of each track section has a width greater than a width of the second end of the track section. As such, a doorway is formed between the concave channel of the second end of the track section, through which players and the game implements are able to traverse. Each doorway has an openable door to allow the players movement between the skating track and a doorway platform. The doorway platform preferably has a set of steps at a rear end thereof.

In some embodiments the skating track is substantially level with a ground surface. In other embodiments wherein the skating track is oval or oblong, just the curved ends are sloped. In still other embodiments, the peripheral edge is raised with respect to the center area. In such embodiments, track panels are each raised at their portion of the peripheral edge, sloped towards the center area, preferably held-up with a sturdy stand proximate the peripheral edge and under the track panel. In this way a portion of the skating track can be raised above and cross over another portion of the skating track.

Preferably the roller skating rink includes one or more propelling devices, each adapted to propel one or more of the game implements into the roller skating rink, such as through an open one of the doorways for example.

One or more scoring receptacles are preferably situated for receiving one or more of the game implements therein proximate the upper end of the concave peripheral wall. Each scoring receptacle is preferably oriented outwardly from the center area of the skating track, such that the game implement in order to be captured by the scoring receptacle must be moving inwardly towards the center area of the skating track. In a preferred implementation, each scoring receptacle has an opening facing the concave peripheral wall at the upper end of the concave peripheral wall, whereby a game implement rolling up the concave peripheral wall may enter the opening when the game implement reaches the upper end of the concave peripheral wall.

Each scoring receptacle allows for visual inspection of the appearance and scoring sequence of any of the game implements deposited therein. As such, preferably at least a portion of each scoring receptacle is transparent, includes netting, or the like.

An inner gutter is preferably included and takes the form of a raised curb surrounding the center area of the skating track, the inner gutter inhibiting the game implements and players from inadvertently leaving the skating track and entering the center area, which is considered out-of-bounds during play. In such an embodiment, the concave peripheral wall is also referred to as the outer gutter.

In use, a skating game is played with two or more teams each having one or more of the players attempting to direct one of the game implements into one of the scoring receptacles to score. The team that achieves a predetermined score first wins the game.

Scoring for a first team preferably takes the form of surrounding an opponent's game implement between two of the first team's game implements, each game implement being preferably one of two contrasting colors. For example, if the scoring receptacle is able to hold up to three of the game implements, a team scoring first one of their game implements into the scoring receptacle, and then one of the opponent's game implements, and then another of their game implements would score a point, referred to as a Nim. Once three of the game implements are captured by the scoring receptacle the scoring receptacle is emptied, with the game implements being returned to one of the propelling devices or "stores" to be reintroduced to the skating track in future play.

Preferably proximate each end of the skating track three of the scoring receptacles are positioned side-by-side to form a 3×3 grid of the game implements when each of the scoring receptacles has captured three of the game implements. In this way points can be obtained by surrounding one of the opponent's game implements with two of the first team's game implements either vertically, horizontally, or diagonally.

During the game, preferably when one of the game implements is captured by one of the scoring receptacles, one of the propelling device propels a corresponding game implement into the skating rink, such that there are almost always a predetermined number of the game implements in play. If there are two colors of the game implements then preferably there are always the same predetermined number of each color of the game implements in play.

The present invention is a sport rink and game that involves a playing surface which extends beyond the surface available to participants in the sport, and which allows for the simultaneous attempts at control of a plurality of game implements (balls) which have been introduced into play by one or a plurality of propelling devices, for placement in a unique manner into a plurality of scoring receptacles, in a predetermined manner where the skating track must be utilized in order to direct a ball into one of the scoring receptacles, and where control of the playing device is done utilizing a device handling tool or stick. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
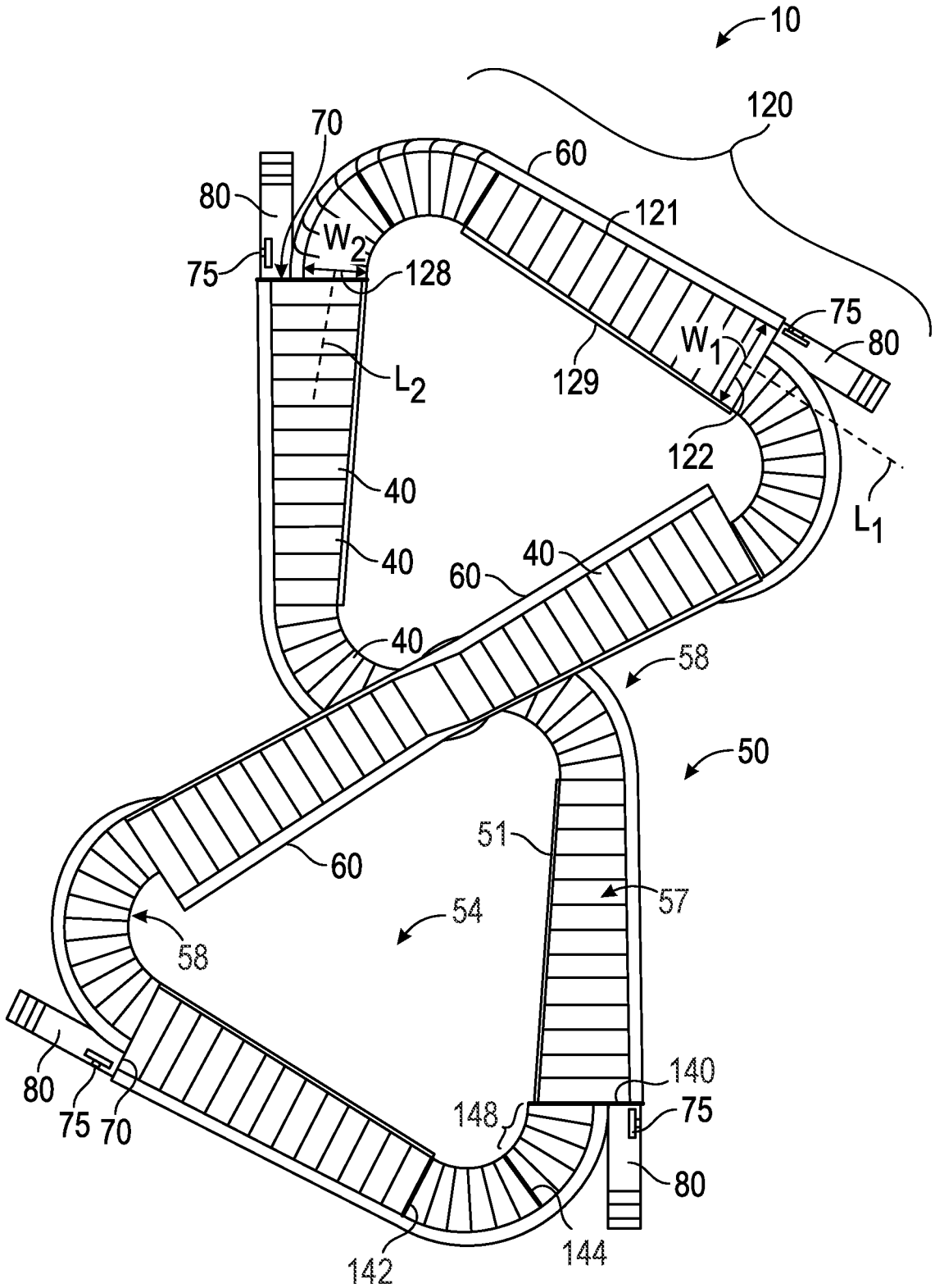
FIG. 1 is a top plan view of a one embodiment of the invention.
Figure 2:
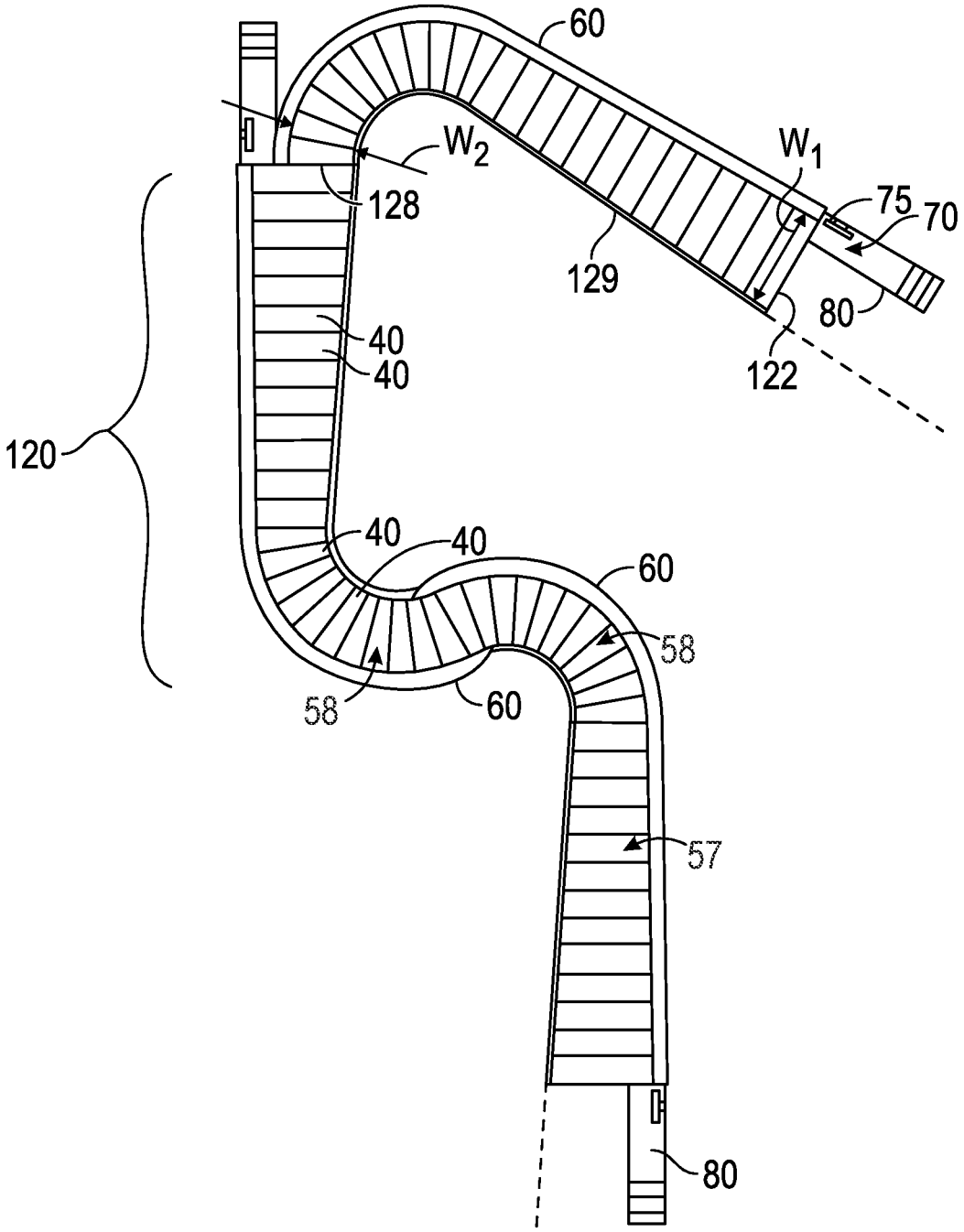
FIG. 2 is a partial top plan view of an alternate embodiment of the invention.
Figure 9:
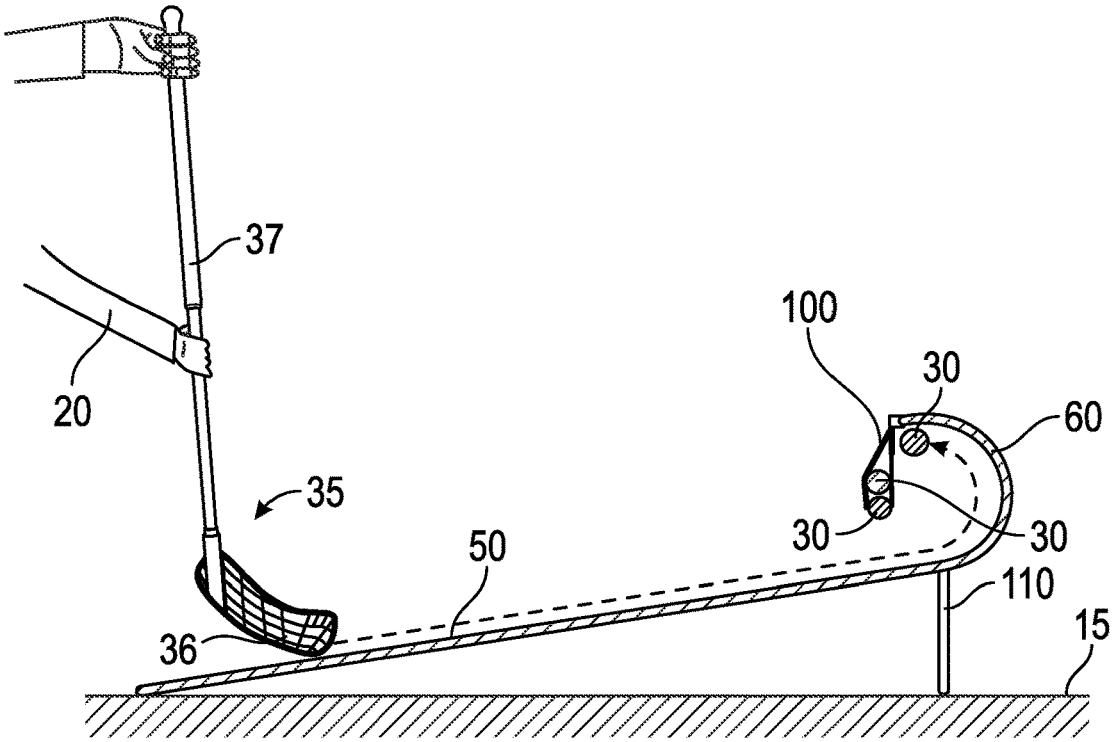
FIG. 9 is a side elevational view of a portion of the invention, illustrating one of the track panels and the concave peripheral wall and further including a scoring receptacle of the invention.
Figure 10:
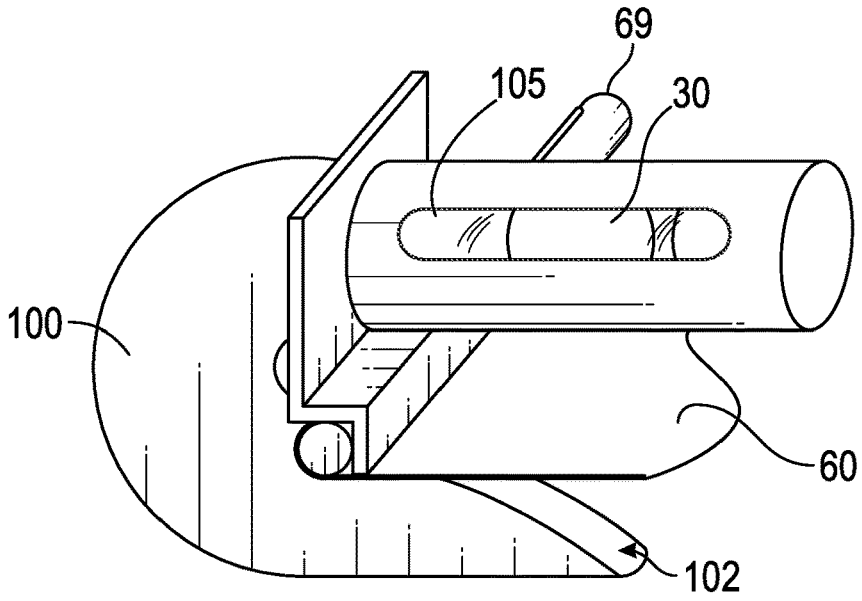
FIG. 10 is a perspective view of one embodiment of the scoring receptacle.
Figure 11:
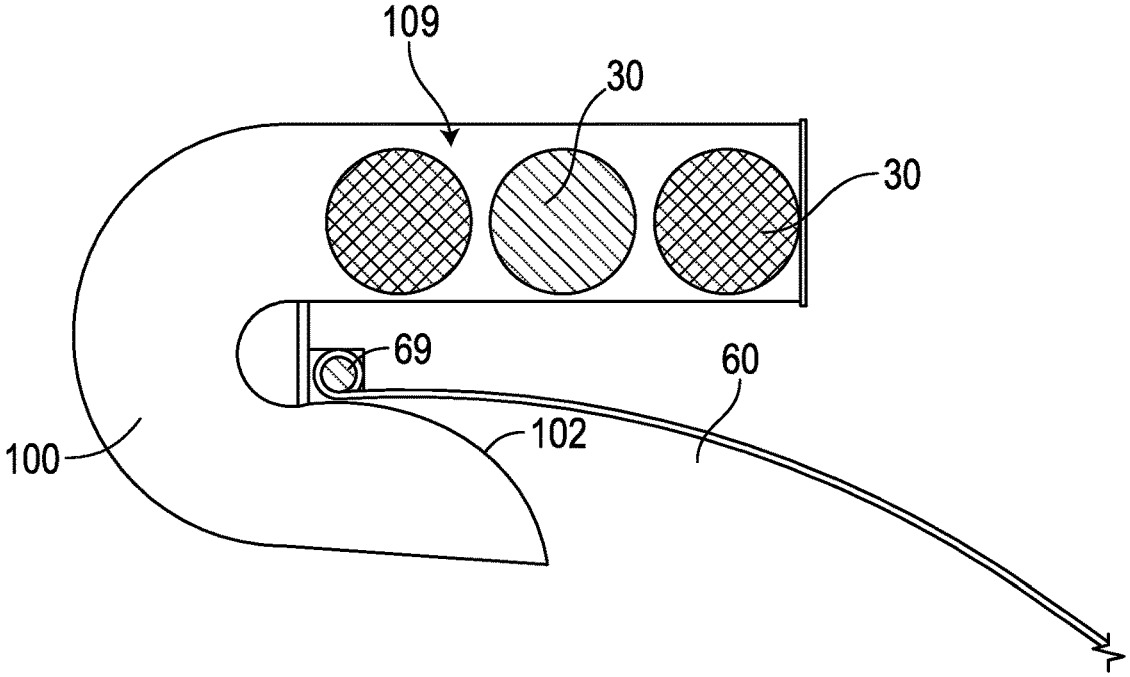
FIG. 11 is a cross-sectional view across a longitudinal axis of the scoring receptacle, further illustrating a holder of the scoring receptacle filled with three game implements.
Figure 12:
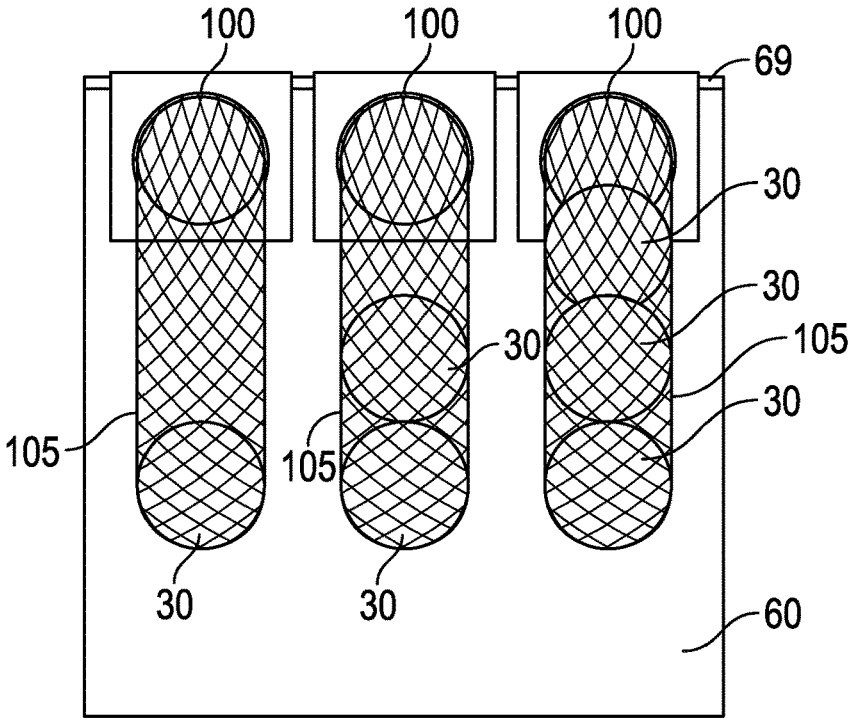
FIG. 12 is a front elevational view of one embodiment of three adjacent scoring receptacles.

FIGS. 1-2 illustrate a roller skating rink 10 for players 20 (FIG. 9) to play a skating game that utilizes one or more game implements 30. A plurality of track sections 120 each include a first end 122, a second end 128, a first side 121, and a second side 129. Each track section 120 rests on a ground surface 15 and is fixed end-to-end with another of the track sections 120 to form a closed-loop skating track 50 for supporting the players 20 and the game implements 30 thereon. Each track section 120 comprises a plurality of abutting track panels 40. Each end 122,128 of each track section 120 has a longitudinal axis $L_1$,$L_2$ substantially orthogonal to the end 122,128, respectively, the longitudinal axes $L_1$ and $L_2$ being mutually non-aligned.

Figure 3A:
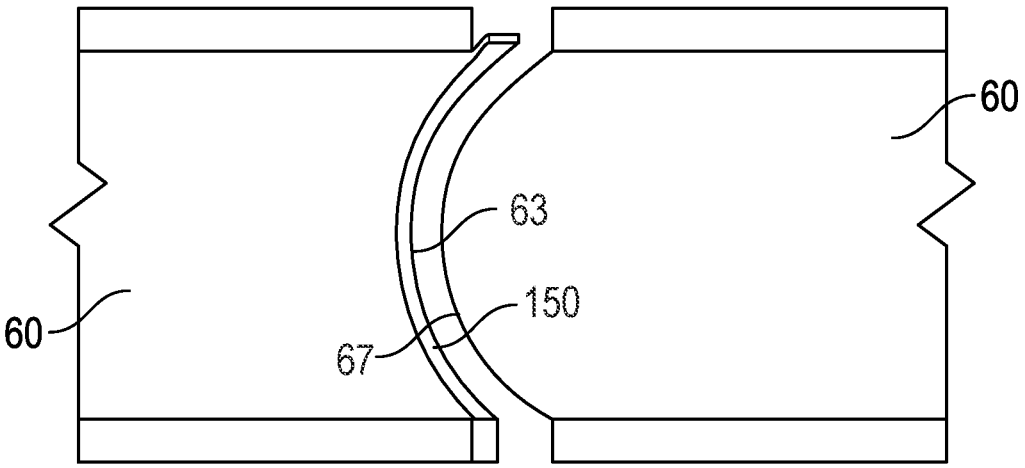
FIG. 3A is a partial, exploded perspective view of two adjacent concave channel sections.
Figure 3B:
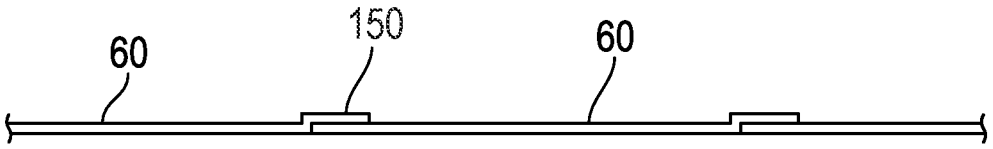
FIG. 3B is a partial cross-sectional view of an interface between two adjacent concave channel sections.
Figure 3C:
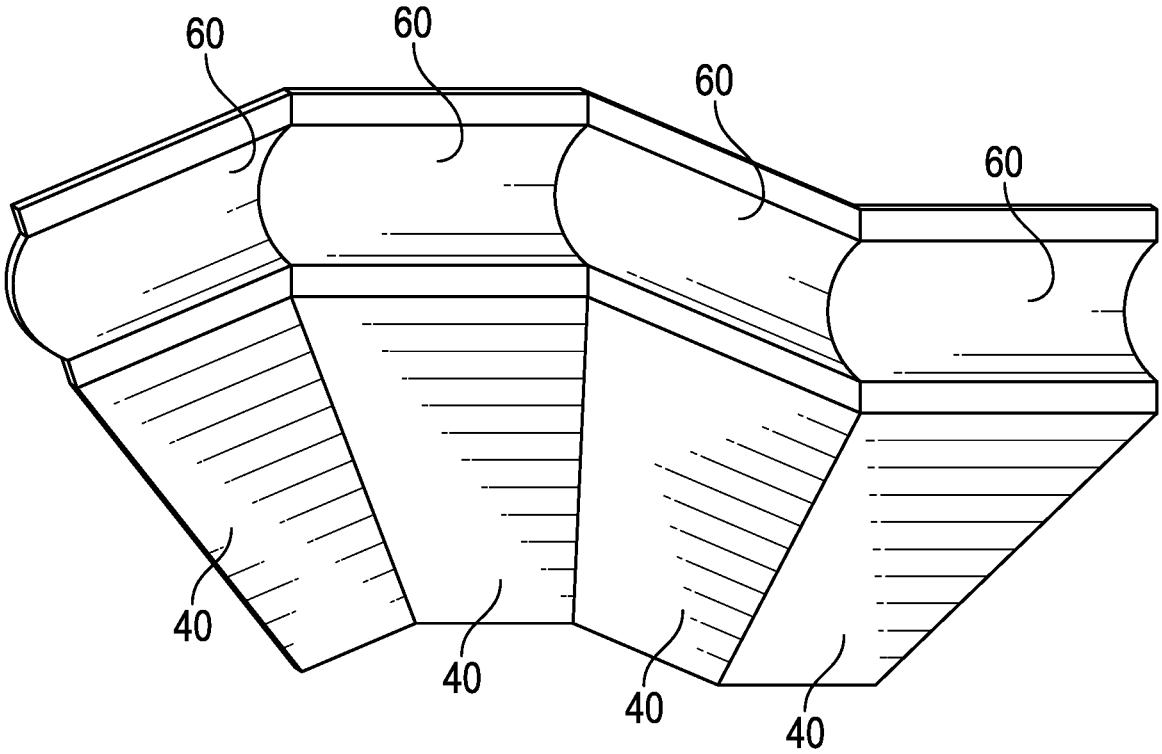
FIG. 3C is a partial perspective view of a plurality of the adjacent concave channel sections forming a curved section of a track.
Figure 3D:
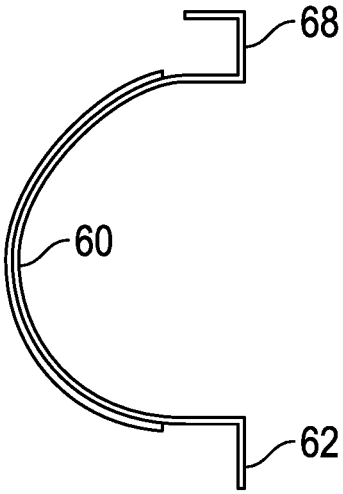
FIG. 3D is an end view of one of the concave channel sections.

A plurality of concave channel sections 60 are each fixed along at least one side 122,128 of each track section 120, each channel section 60 having a lower end 62 and an upper end 68. The lower end 62 and the upper end 68 are substantially vertically aligned. The concave channel sections 60 of two abutting track panels 40 each mutually abut each other, with a first end 63 thereof being curved inwardly and a second end 67 thereof being curved outwardly (FIG. 3A). The upper ends 68 of each concave channel section 60 are held together with a peripheral cable or metal rod 69, latching hardware (not shown), interlocking tongue-in-groove structures (not shown), or the like. In some embodiments the first end 63 includes a flange 150 such that the second end 67 of an abutting concave channel section 60 engages with and forms a smooth transition from one concave channel 60 to the abutting concave channel 60.

The first end 122 of each track section 120 has a width $W_1$, greater than a width $W_2$ of the second end 128 of the track section 120. As such, a doorway 70 is formed between the concave channel 60 of the second end 128 of the track section 120, through which players 20 and the game implements 30 are able to traverse. Each doorway 70 has an openable door 75 to allow the players 20 movement between the skating track 50 and a doorway platform 80. The doorway platform 80 preferably has a set of steps 85 at a rear end 88 thereof.

Figure 4:
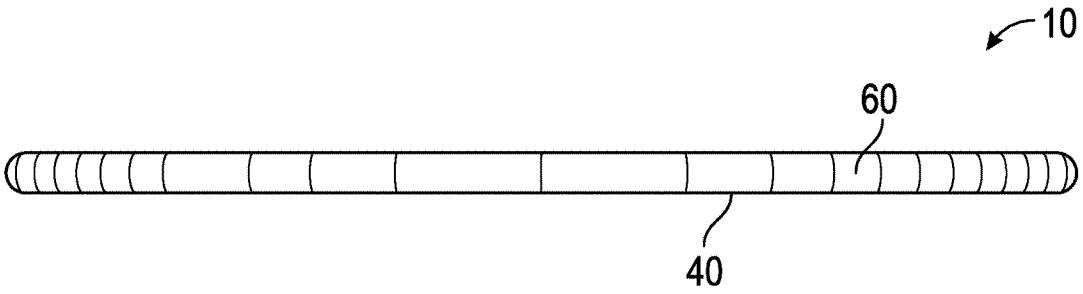
FIG. 4 is a side elevational view of one embodiment of the invention.
Figure 5:
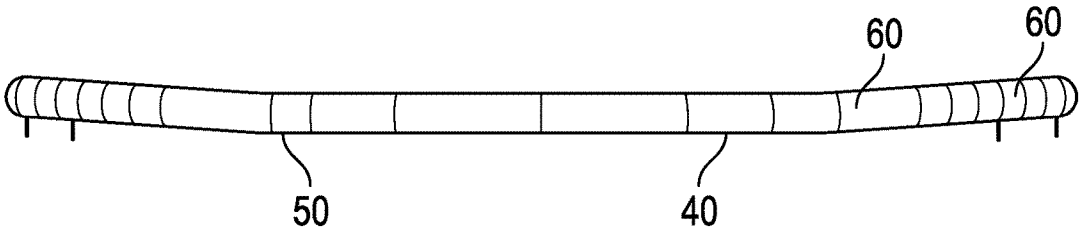
FIG. 5 is a side elevational view of an alternate embodiment of the invention.
Figure 6:
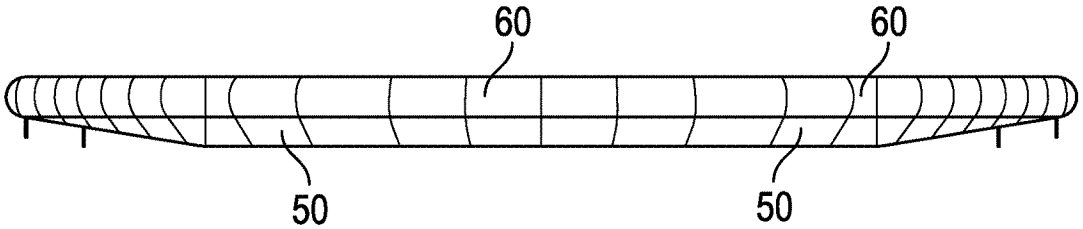
FIG. 6 is a side elevational view of another alternate embodiment of the invention.
Figure 7:
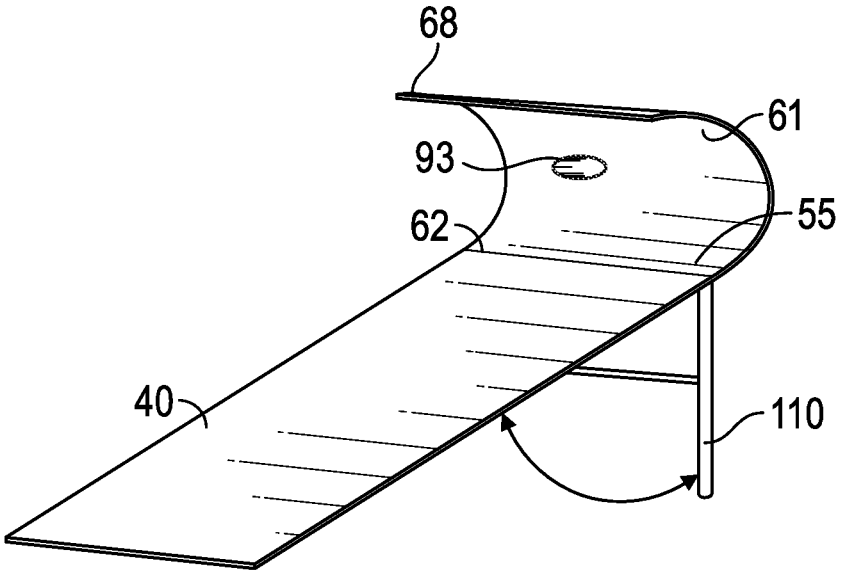
FIG. 7 is a partial perspective view of a track panel and a concave peripheral wall of the invention.

In some embodiments the skating track 50 is substantially level with a ground surface 15 (FIG. 4). In other embodiments wherein the skating track 50 is oval or oblong, just the curved ends 58 are sloped (FIG. 5). In still other embodiments, the peripheral edge 55 is raised with respect to the center area 54 (FIG. 6). In such embodiments, track panels 40 are each raised at their portion of the peripheral edge 55, sloped towards the center area 54, preferably held-up with a sturdy stand 110 (FIG. 7) proximate the peripheral edge 55 and under the track panel 40. In this way a portion of the skating track 50 can be raised above and cross over another portion of the skating track 50 (FIG. 1).

Preferably the roller skating rink 10 includes one or more propelling devices 90, each adapted to propel one or more of the game implements 30 into the roller skating rink 10, such as through an open one of the doorways 70 for example. Alternately, each propelling device 90 may be cooperative with an aperture 93 (FIG. 7) in the concave peripheral wall 60 such that the propelling device 90 propels one of the game implements 30 into the roller skating rink 10 through such aperture 93. Alternately, the propelling device 90 may be positioned to propel the game implement 30 over the concave peripheral wall 60 and onto the skating track 50.

One or more scoring receptacles 100 (FIGS. 9-12) are preferably situated for receiving one or more of the game implements 30 therein proximate the upper end 68 of the concave peripheral wall 60. In a preferred implementation, each scoring receptacle 100 has an opening 102 facing the concave peripheral wall 60 at the upper end 68 of the concave peripheral wall 60, whereby a game implement 30 rolling up the concave peripheral wall 60 may enter the opening 102 when the game implement 30 reaches the upper end 68 of the concave peripheral wall 60, presuming that the trajectory of the game implement 30 coincides with the opening 102.

Each scoring receptacle 100 allows for visual inspection of the appearance and scoring sequence of any of the game implements 30 deposited therein. As such, preferably at least a portion 105 (FIG. 10) of each scoring receptacle 100 is transparent, includes netting (not shown), or the like.

An inner gutter 51 is preferably included and takes the form of a raised curb on the second side 129 of each track section 120, the inner gutter 51 inhibiting the game implements 30 and players 20 from inadvertently leaving the skating track 50, which is considered out-of-bounds during play. In such an embodiment, the concave peripheral wall 60 is also referred to as the outer gutter 60. In some embodiments where the outer gutter 60 or inner gutter 51 abruptly terminate at the doorway 70, a deflector (not shown) may be used to cause any of the game implements 30 traveling along the gutter 60,51 to be deflected outwardly into the track 50 to avoid getting trapped at the doorway 70. In other embodiments all of the doorways 70 are facing towards a skating direction so that a game implement 30 is not trapped in one of the doorways 70 as the game implement 30 moves along the track 50 in the skating direction.

In use, a skating game is played with two or more teams each having one or more of the players 20 attempting to direct the game implements 30 into one of the scoring receptacles 100 to score. The team that achieves a predetermined score first wins the game.

Scoring for a first team preferably takes the form of surrounding an opponent's game implement 30 between two of the first team's game implements 30, each game implement 30 being preferably one of two contrasting colors. For example, if the scoring receptacle 100 is able to hold up to three of the game implements 30, a team scoring first one of their game implements 30 into the scoring receptacle 100, and then one of the opponent's game implements 30, and then another of their game implements 30 would score a point, referred to as a "Nim" 109. Once three of the game implements 30 are captured by the scoring receptacle 100 the scoring receptacle 100 is emptied, with the game implements 30 being returned to one of the propelling devices 90 to be reintroduced to the skating track 50 in future play.

In one embodiment proximate each curved end 58 of the skating track 50 three of the scoring receptacles 100 are positioned side-by-side to form a 3×3 grid of the game implements 30 (FIG. 12) when each of the scoring receptacles has captured three of the game implements 30. In this way points can be obtained by surrounding one of the opponent's game implements 30 with two of the first team's game implements 30 either vertically, horizontally, or diagonally.

During the game, preferably when one of the game implements 30 is captured by one of the scoring receptacles 100, one of the propelling device 90 propels a corresponding game implement 30 into the roller skating rink 10, such that there are almost always a predetermined number of the game implements 30 in play. If there are two colors of the game implements 30 then preferably there are always the same predetermined number of each color of the game implements 30 in play.

In one preferred specific method of play, there are eight teams each of at least two of the players 20, where subsequent teams enter the match to replace the losing team of each round.

The game is played on the oval embodiment of the skating track 50, what is referred to as the "Cancha" 50, which is composed of flat track straightaways 57 and banked end zones 58, or curved ends 58, with both an inner gutter 51 and an outer gutter 60, or curved concave peripheral wall 60, acting as track boundaries.

The doorway 70 for players 20, and one of the propelling devices 90, or "Canon" 90 for the game implements 30, also referred to as a "Pelota" 30 (or a ball 30), is placed at the beginning of one of the curved ends 58 when moving in a counter-clockwise direction at a top end of the track 50 (FIG. 1). Access to the center area 54 is considered "out-of-bounds" and restricted to reserve players 20, coach players 20, referees (not shown), the chief umpire (not shown), and inactive players 20, for example.

The scoring receptacles 100, called "Mancalas" 100, may be placed in groups of three at the end of each flat track straightaway 57, and before the curved end 58. Each scoring receptacles 100 can hold, for example, up to three balls 30. The Mancalas 100 may be positioned at the upper end 68 of the outer gutter 60 and oriented to hang below the upper end 68 so that an accurately projected ball 30 must curve up into the outer gutter 60 and bank into the Mancala 100.

The skating track 50 may be marked with a at least one Starting Line 140, for example at the doorway 70 position where the Canon 90 injects Pelotas 30 into the Cancha 50. The skating track 50 may also be marked with at least one Pass Line 142 at a start flat track straightaway 57, that is, at an intersection of the curved end 58 meets the beginning of the flat track straightway 57 (FIG. 1). The skating track 50 may further be marked with at least one Shot Line 144 between the Starting Line 140 and the Pass Line 142.

In one embodiment of the game there are two sets of the game implements 30, or balls 30 or "Pelotas 30." A first set of the balls 30 is colored, for example, red, and a second set of the balls 30 is colored white, with nine of the balls 30 in each set. Balls 30 may be the size and weight of regulation Cricket Balls, for example.

Each player 20 has a playing implement 35 for handling balls 30, also referred to as a ball handling "Cesta" 35 (FIG. 9) similar in style to a hockey stick or a shinty stick, which the players 20 use to catch and throw the balls 30 during play. The Cesta 35 preferably has the basic shape of a regulation hockey stick, but a head 36 of the Cesta 35 may be shaped to form a basket or net, similar to a Lacrosse stick head, allowing the player 20 to achieve better control of the balls 30 during play. The length of a Cesta handle 37 or stick 35 preferably extends no higher than the player's midriff (navel).

Players 20 must wear approved safety equipment (not shown), consisting at a minimum of gloves, a helmet, with face guard, a mouth guard, shoulder, elbow and knee pads, plus other approved apparel. Players 20 are preferably using "quad" roller skates as opposed to "in-line" roller skates for safety.

Preferably all players 20 wear uniforms (not shown) consisting of jerseys, shorts and knee socks, visually distinctive from the uniforms of players 20 on other teams. A team's uniform may have any color combination, but may not match another team in their league. Each team preferably has an alternate jersey with a reversed color combination for inter-team play and practice. A player's socks should be mutually uniform and pulled up to knee guards.

All jerseys are preferably numbered uniquely for each player 20 in clearly visible Arabic figures in colors that contrast with the color of the jersey, displayed on both a back and on a front of the jersey.

A team shall have five of the players 20, with a maximum of three of the players 20 on the Cancha 50 at any time. Two team players 20 in play on the Cancha 50 are preferably designated as offensive players 20, and the third player 20 is designated as a defensive player 20. A fourth player 20 on each team is a reserve or substitute player 20, and may only enter play when tagged to relieve an active player 20. The fifth player 20 shall be designated as a Coach player 20 and may only enter play or the Cancha 50 in the case of injury to an active player 20 or ejection of an active player 20 from the game.

Reserve or substitute players 20 sit in the center area 54 during regulation play. Coaches whose teams are not in the current, or the upcoming two games or rounds, may act as umpires for the current round with the exception that the coach of the third upcoming round is designated as the Chief Referee for the current round or game.

During play, a team may play as either a "Red" or a "White" team, for example, designated by a color of their helmet covers, and the color of the Pelotas 30 they are assigned. Clearly other colors could be used instead, such as green, blue, gold, black, yellow, orange, brown, or the like.

The game is played in a "Round Robin" format where the first team to win a predetermined number of points is declared the match winner. The first round a team shall play shall be determined by lot, with subsequent rounds being determined by position in the sequence of lost rounds.

Play continues until three top winners are decided, with first place going to the winner of the match, second place to the team with the second highest number of rounds won or points scored, and third place to the team with the third highest number of rounds won or points scored.

The game is played in rounds, with a match being composed of a minimum of six teams and a maximum of eight teams participating in a match. There is no time limit on a round, which continues until one team has created a Nim 109. In case of injury or for safety, the game may be stopped or a timeout called by an Umpire or the Chief Referee, however, neither team players 20 nor coaches may call for a timeout during a round.

A team wins a round by being the first team to create a "Nim" 109, defined as a combination of three balls 30, where two balls 30 are of one color and one ball 30 is of the opposing color. The team whose ball 30 "tops off" or completes the Nim 109 in a Mancala 100 with their team color Pelota 30 receives the win and score for that round. Nims 109 may be arranged in any direction in a single mancala 100 or a combination of the three Mancalas 100. The allowable scoring lines are, in this way, reminiscent of the game of "tic-tac-toe."

At the end of a round, the winning team of that round will remain on the skating track 50 to continue play with another team, which will enter for a new round. The new team will take on the colors of the team that is leaving the skating track 50. The team leaving the skating track 50 will return to the "infield" or center area 54 and wait at the end of rotation to play another round.

The Chief Referee for the current round begins play by causing Pelotas 30 to be simultaneously injected (or fired) into the Cancha 50 from the canons 90 placed at each doorway 70. Red Pelotas 30 are injected (or fired) from the canon 90 located nearest the starting line 140 of the "red" team, and white Pelotas 30 are injected (or fired) from the Canon 90 located nearest the Starting Lines 140 of the "white" team.

At the start of each round, offensive players 20 are positioned at each starting line 140, corresponding with the Pelota 30 they have been assigned, and a defensive player 20 from each team is positioned between the opposing offensive players 20.

Players 20 preferably may only skate the Cancha 50 in a counter-clockwise direction. Players 20 may skate facing any direction, forward or backward, but body motion remains in a counter-clockwise direction relative to the Cancha 50. In an alternate embodiment all or some of the players 20 play in a clockwise direction.

Players 20 may pass the Pelota 30 in either a clockwise or counter-clockwise direction. Shooting a Pelota 30 into the Mancala 100 may only be done in a counter-clockwise direction. Players 20 may not "cradle" the ball 30 with their Cesta 35 more than nine seconds, at which time they may either pass, attempt a goal shot towards the scoring receptacles 100, pass the Pelota 30 across two of the lines 140,142,144, or yield control of the Pelota 30.

Players 20 may compete or play using a Pelota 30 from either their own, or the other teams available Pelota 30, however they may only score when a Pelota 30 bearing the color assigned to their team "tops off" or completes a Nim 109, meaning that color Pelota 30 is the same for the first and third Pelotas 30 to create the Nim 109, regardless of which team shot the Pelotas 30 into their team's Mancala 100.

A team may score by using any Mancala 100, and all Mancalas 100 are in play. All Pelotas 30 are in play, however, preferably in this game there may not be more than two Pelotas 30 on the skating track 50 at any one time. A Pelota 30 may not be directed or "shot" into the Mancala 100 from any position between the "Shot Line" 144 and the next set of Mancalas 100.

The area between the Shot Line 144 and the Starting Line 140, also referred to as the "End Zone" 58, shall be the banked or raised curved ends 58 of the Cancha 50. Pelotas 30 that deposit into or top off a Mancala 100 after being shot from within the "End Zone" 58 shall be removed by an Umpire at the direction of the Chief Referee and returned to its team inventory of Pelotas 30. The team responsible for any extra Pelotas 30 on the skating track 50 has the corresponding number of Pelotas 30 removed from play.

Players 20 may tag a relief player 20 at any time during play, but the relief player 20 may not enter the Cancha 50 until the retiring player 20 has left the Cancha 50. A player 20 may not be tagged back into the same round, nor start a subsequent round until they have been tagged back in.

Penalties shall be assessed for player actions that endanger other players 20 by causing injury, or have the potential to cause injury. A penalty shall be assessed against a player 20 for contact with an opposing team member 20 with a Cesta 35 at a level above the opposing team member's shoulders. When an opponent has the Pelota 30 or is within five yards of a Pelota 30, a player 20 can body check or block them. A body check is contact from the front between the waist and the shoulders. A player 20 may also stick check the player 20 on the stick 35 or gloves to try and knock the Pelota 30 away or to keep a player 20 from getting a free Pelota 30.

There is an area between the Mancala 100 and the Shot Line 144 called a crease 148 (FIG. 1). An opponent is not allowed to make contact in the crease 148, but they can reach in with their stick or Cesta 35 to block a shot or take control of the Pelota 30.

When a player 20 with the Pelota 30, or the Pelota 30 itself, goes out of the field of play, the opposing team gets the Pelota 30 unless the Pelota 30 goes out of bounds after a shot. In that case, the team with the player 20 closest to the Pelota 30 when it went out of bounds gets the Pelota 30.

Plays that are not allowed are called fouls. If a player 20 commits a foul, their team will have one Pelota 30 removed from active play for that round. At five personal fouls the player 20 is removed from the game. Personal fouls include tripping, unnecessary roughness, cross checking (making contact with another player 20 with the stick 35 or Cesta 35 between one's hands), slashing (a stick check not on the opponents gloves or stick 35), or illegal body checking (such as blind side and full body blocks). Some technical fouls include holding, offsides (not the right number of players 20 on the Cancha 50), stalling, and pushing. Players 20 will not at any time physically abuse any official, opponent, spectator or other person within the precincts of the match site. For purposes of this rule, physical abuse is the unauthorized touching of an official, opponent, and spectator or another person.

Figure 8:
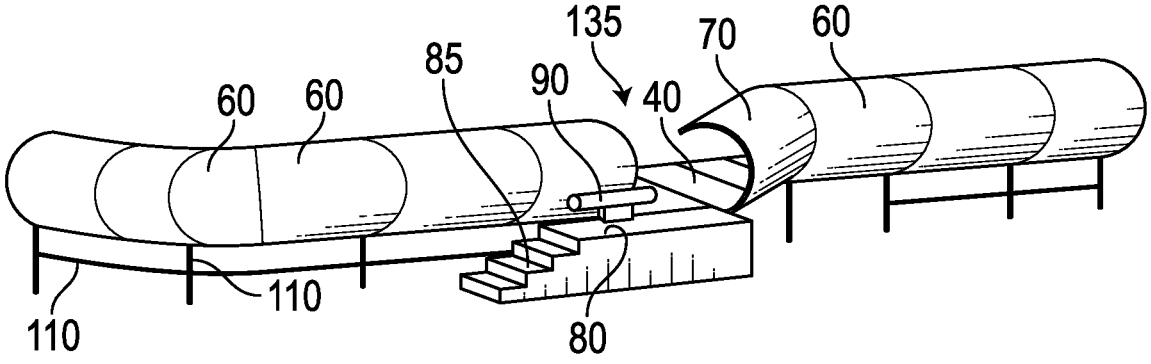
FIG. 8 is a perspective view of a portion of the invention, illustrating a doorway platform with one of the doors in the open position.

While a particular form of the invention has been illustrated and described, it will be apparent that various modifications can be made without departing from the spirit and scope of the invention. For example, the shape of the skating track 50 may be a figure-8, square with rounded corners, or other shape. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A roller skating rink for players to play a skating game utilizing one or more game implements, the skating rink comprising:

a plurality of track sections that each include a first end, a second end, a first side, and a second side, each track section fixed end-to-end with another of the track sections to form a closed-loop skating track for supporting the players and the game implements thereon, each track section comprising a plurality of abutting track panels, each end of each track section having a longitudinal axis substantially orthogonal to the end of the track section, each track panel having a portion of the first side of the track section and of the second side of the track section;

a plurality of concave channel sections each fixed along at least one side of each track panel and having a lower end and an upper end, the lower end and the upper end being substantially vertically aligned, wherein the concave channel sections of two abutting track panels each mutually abut each other at first and second ends thereof and form a part of a peripheral wall, the peripheral wall comprising all of the concave channel sections;

at least some of the track sections having a longitudinal axis at the first end forming an angle with the longitudinal axis at the second end that does not equal 180-degrees;

wherein the first end of each track section has a width greater than a width of the second end of the track section, whereby a doorway is formed between the first end of the track section and the second end of the next adjacent track section, players and game implements being able to traverse the doorway, one or more propelling devices each adapted to propel one of the game implements into the skating rink through one of the doorways.

2. The roller skating rink of claim 1 wherein each doorway has within an openable door to allow the players movement between the skating track and a doorway platform.

3. The roller skating rink of claim 1 wherein the peripheral wall includes one or more scoring receptacles situated for receiving one or more of the game implements therein proximate the upper end of the peripheral wall.

4. The roller skating rink of claim 3 wherein each scoring receptacle is oriented towards the peripheral wall, whereby the game implement in order to be captured by the receptacle must be moving inwardly away from the peripheral wall.

5. The roller skating rink of claim 4 wherein each scoring receptacle allows for visual inspection of the visual appearance and scoring sequence of any of the game implements deposited therein.

6. The roller skating rink of claim 4 wherein at least a portion of each scoring receptacle is transparent.

7. The roller skating rink of claim 1 wherein each track panel further includes a stand proximate the second side of the track panel that, when deployed, raises or lowers the second side of the track panel to provide for a sloped skating track.

8. The roller skating rink of claim 7 wherein the first end of each concave channel section includes a flange such that the second end of an abutting concave channel section engages therewith to form a smooth transition between each concave channel section.

9. The roller skating rink of claim 1 wherein the first end of each concave channel section is curved outwardly and the second end of each concave channel section is curved inwardly.

10. The roller skating rink of claim 9 wherein the first end of each concave channel section includes a flange such that the second end of an abutting concave channel section engages with and forms a smooth transition from one concave channel section to the abutting concave channel section.

11. A roller skating rink for players to play a skating game utilizing one or more game implements, the skating rink comprising:

a plurality of track panels that each include a first end, a second end, a first side, and a second side, each track panel fixed end-to-end with at least one other of the track panels to form a track section, a plurality of the track sections being formed thereby;

each track section includes a first end, a second end, a first side, and a second side, each track section fixed end-to-end with another of the track sections to form a closed-loop skating track for supporting the players and the game implements thereon, each end of each track section having a longitudinal axis substantially orthogonal to the end of the track section, each track panel having a portion of the first side of the track section and of the second side of the track section;

a plurality of concave channel sections each fixed along at least one side of each track panel and having a lower end and an upper end, the lower end and the upper end being substantially vertically aligned, wherein the concave channel sections of two abutting track panels each mutually abut each other at first and second ends thereof and form a part of a peripheral wall, the peripheral wall comprising all of the concave channel sections;

at least some of the track sections having a longitudinal axis at the first end forming an angle with the longitudinal axis at the second end that does not equal 180-degrees;

wherein the first end of each track section has a width greater than a width of the second end of the track section, whereby a doorway is formed between the first end of the track section and the second end of the next adjacent track section, players and game implements being able to traverse the doorway, one or more propelling devices each adapted to propel one of the game implements into the skating rink through one of the doorways.

12. The roller skating rink of claim 11 wherein each track panel further includes a stand proximate the second side of the track panel that, when deployed, raises or lowers the second side of the track panel to provide for a sloped skating track.

13. The roller skating rink of claim 11 wherein the first end of each concave channel section is curved outwardly and the second end of each concave channel section is curved inwardly.

14. The roller skating rink of claim 13 wherein the first end of each concave channel section includes a flange such that the second end of an abutting concave channel section engages therewith to form a smooth transition between each concave channel section.

* * * * *